US006814516B2

(12) United States Patent
Tsuchiya et al.

(10) Patent No.: US 6,814,516 B2
(45) Date of Patent: Nov. 9, 2004

(54) PRINTER HAVING A CUTTING APPARATUS THAT MAINTAINS A RELATIVE POSITION BETWEEN A MOVABLE CUTTER AND A REMOVABLE FIXED CUTTER

(75) Inventors: Masahiro Tsuchiya, Shinagawa (JP); Hiromi Ohtsuka, Shinagawa (JP); Fumio Sakurai, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 10/342,299

(22) Filed: Jan. 15, 2003

(65) Prior Publication Data

US 2003/0198499 A1 Oct. 23, 2003

(30) Foreign Application Priority Data

Apr. 23, 2002 (JP) ..... 2002-120731

(51) Int. Cl.[7] ..... B41J 11/26
(52) U.S. Cl. ..... 400/621; 400/611
(58) Field of Search ..... 400/621, 693, 400/691, 690.4, 611, 621.1; 347/220, 222

(56) References Cited

U.S. PATENT DOCUMENTS 5,579,043 A * 11/1996 Patry ..... 347/222
5,631,690 A * 5/1997 Tashiro et al. ..... 347/220
5,833,380 A * 11/1998 Hosomi et al. ..... 400/621
6,361,231 B1 3/2002 Sato et al. ..... 400/621
6,447,187 B1 * 9/2002 Robinson ..... 400/621

FOREIGN PATENT DOCUMENTS

JP 2000-272200 10/2000

* cited by examiner

*Primary Examiner*—Anthony H. Nguyen
(74) *Attorney, Agent, or Firm*—Staas & Halsey LLP

(57) ABSTRACT

A printer with a guillotine cutter having a movable cutter and a removable fixed cutter in which the relative position between the fixed cutter and the movable cutter does not vary. A cutter fitting member with a bottom plate and a pair of side plates is fixed to the outside of a casing. The side plates respectively have a first projection with positioning holes and a second projection. A movable cutter driving section of the guillotine cutter has small projections that engage the positioning holes, and is fixed to the first projection with screws. The removable fixed cutter is disposed on the second projection with a bottom surface of a projection of the fixed cutter in the width direction closely contacting a first side of the cutter fitting member, and a right end surface of the fixed cutter projection closely contacting a second side of the cutter fitting member.

7 Claims, 10 Drawing Sheets

PRINTER HAVING A CUTTING APPARATUS THAT MAINTAINS A RELATIVE POSITION BETWEEN A MOVABLE CUTTER AND A REMOVABLE FIXED CUTTER

BACKGROUND OF THE INVENTION

1. Field of the Invention

The present invention relates to a printer, and relates, more particularly, to a printer that has a guillotine cutter having a movable cutter and a fixed cutter which is arranged removable.

2. Description of the Related Art

While printers are being used in a very wide range of fields, certain types of printers, particularly small printers, often use roll paper. Printers that use roll paper are equipped with a cutter for cutting the roll paper at a predetermined position. Among various types of cutters, there is a cutter called a guillotine cutter that slides a movable cutter on the surface of a fixed cutter. On the other hand, roll paper is exchanged frequently in the small printers. In order to facilitate the exchange of roll paper, or in order to clean the inside of the printer, some printers have a platen connected to the fixed cutter of the guillotine cutter, and these units can be integrally removed.

In a guillotine cutter, it is difficult to well cut paper when the position of the moving line of the movable cutter relative to the fixed cutter is deviated. When the fixed cutter is removable, a deviation in the position of the moving line of the movable cutter relative to the fixed cutter possibly occurs. As a result, there arises a problem that it is not possible to obtain a satisfactory cutting action.

SUMMARY OF THE INVENTION

The present invention has been made in the light of the above problems. It is, therefore, an object of the invention to provide a printer that has a guillotine cutter having a fixed cutter and a movable cutter, and the fixed cutter is removable, and that has no variation in the relative position between the fixed cutter and the movable cutter.

In order to achieve the above object, according to one aspect of the present invention, there is provided a printer comprising a guillotine cutter having a fixed cutter and a movable cutter that is movable toward the fixed cutter, wherein the fixed cutter is provided with a platen via a platen supporting member, and is removable together with the platen, the printer has a cutter fitting member fixed and integrally formed with a printer casing that accommodates a printer main body including a printing section, the cutter fitting member having a bottom plate and a pair of side plates erected on the bottom plate, a movable cutter driving member that drives the movable cutter is positioned on the cutter fitting member with a movable cutter positioning unit, and the fixed cutter is positioned on the cutter fitting member with a fixed cutter positioning unit, with the fixed cutter positioning unit formed on the upper end of the side plates of the cutter fitting member.

According to the printer having the above structure, the movable cutter and the fixed cutter of the guillotine cutter are positioned on the cutter fitting member that is integrally formed and has a bottom plate and a pair of side plates erected on the bottom plate. Therefore, the relative position is not deviated. Further, as the fixed cutter positioning unit for positioning the fixed cutter is formed on the upper end of the side plates of the cutter fitting member, the machining is easy.

According to another aspect of the invention, a platen stopper is fitted to the printer casing, and when an shaft of the platen fitted to the fixed cutter via the platen supporting member is inserted into a guide provided on the printer casing, the platen stopper applies force to press the fixed cutter against the fixed cutter positioning unit.

According to still another aspect of the invention, a relative angle between the fixed cutter and the movable cutter is adjusted by changing the fixed cutter positioning unit or the movable cutter positioning unit.

According to still another aspect of the invention, a full cut and a partial cut are changeable by changing the position of the movable cutter driving member using the movable cutter positioning unit.

According to still another aspect of the invention, on both ends of the movable cutter in its width direction, there are provided guiding sections that first ride on the upper surface of the fixed cutter when the movable cutter moves toward the fixed cutter, and either the fixed cutter or the movable cutter or both the fixed cutter and the movable cutter have ride smoothing units that make the guiding sections ride smoothly on the fixed cutter.

Preferably the ride smoothing unit is made by upwardly bending the guiding section to make it ride on the fixed cutter.

Preferably the ride smoothing unit is made by cutting off the width end portion of the upper edge fixed at the movable cutter side.

Preferably the ride smoothing unit is made by tapering down the both width ends of the upper surface of the fixed cutter.

According to still another aspect of the invention, the platen supporting member is fitted to the fixed cutter via a spring member, and the spring member always applies force to the platen supporting member against the fixed cutter.

According to still another aspect of the invention, a roll paper guide that prevents a jam of the roll paper is formed on the spring member.

According to still another aspect of the invention, the platen supporting member is fitted to the fixed cutter with a play.

The present invention may be more fully understood from the description of preferred embodiments of the invention set forth below, together with the accompanying drawings.

DETAILED DESCRIPTION OF THE PREFERRED EMBODIMENTS

Embodiments of the present invention will be explained below with reference to the attached drawings.

Figure 1:
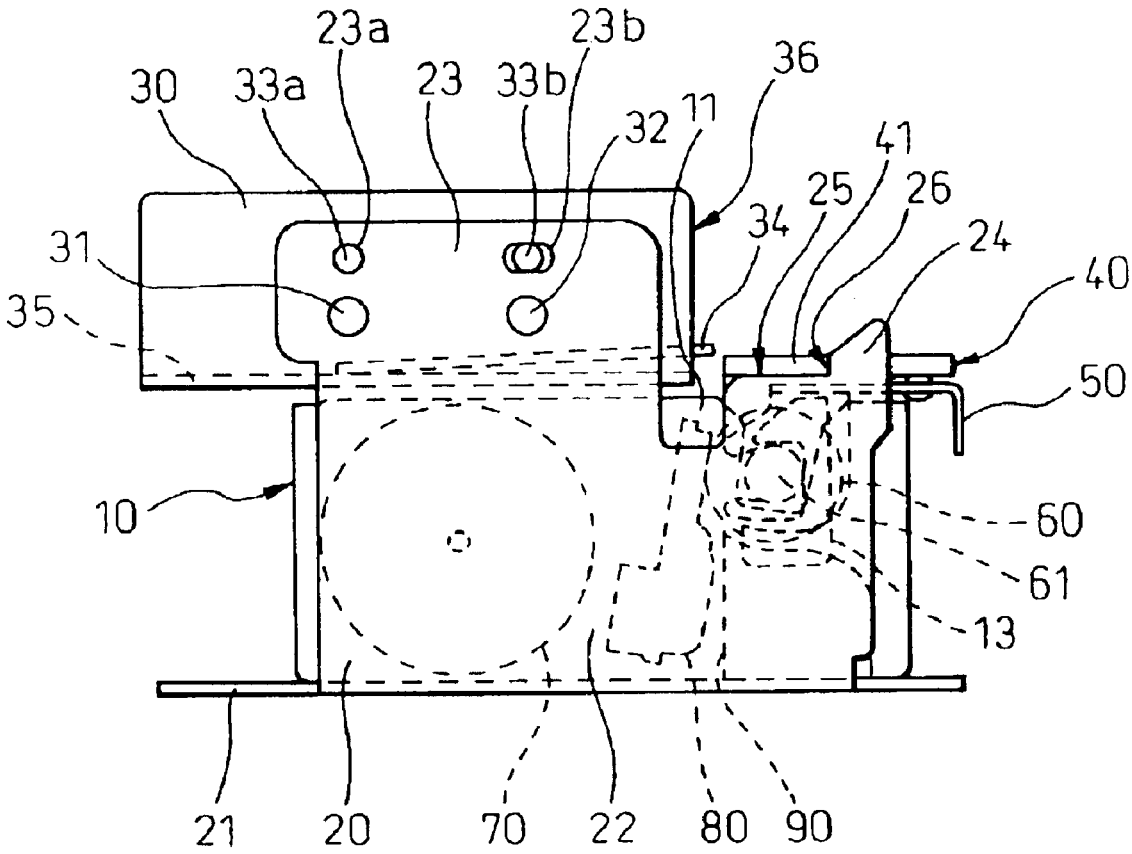
FIG. 1 is a side view of a printer according to a first embodiment of the present invention.

FIG. 1 is a side view that shows characteristics of a first embodiment of a roll paper printer having a guillotine cutter according to the present invention. A printer main body that includes a driving motor 70, a thermal head 80, and a roll paper guiding member 90 is installed inside a casing 10 having its upper end opened. A cutter fitting member 20 that has a U-shaped cross section, with the upper end opened, and has a bottom plate 21 and a pair of side plates 22, is fixed to the outside of this casing 10.

Roll paper is wound around a winding core and supported by a roll paper supporting member not shown. The roll paper passes through between a roll paper guiding member 13 and a platen 60. Characters are printed on the roll paper when it passes through the platen 60 and the thermal head 80. The roll paper is then directed upward, and is discharged to the upper space from between a movable cutter 34 and a fixed cutter 40 in FIG. 1. At a desired position, the movable cutter is moved to a right direction in the drawing to cut the roll paper.

The side plates 22 of the cutter fitting member 20 have a first projection 23 and a second projection 24. A movable cutter driving section 30 of the guillotine cutter is fixed to the first projection with screws 31 and 32. The cutter fitting member 20 has positioning holes 23*a* and 23*b*. Small projections 33*a* and 33*b* of the movable cutter driving section 30 are engaged with the positioning holes 23*a* and 23*b*. With this arrangement, the fitting position of the movable cutter driving section 30 to the cutter fitting member 20 does not deviate.

The movable cutter driving section 30 moves the movable cutter 34 on a movable cutter guiding plate 35 with a movable cutter driving motor not shown, in a posture that the movable cutter 34 is slightly lifted at the fixed cutter side as shown in the drawing. Therefore, although not shown in the drawing, the lower portion of the inside the movable cutter driving section 30 has a free space to enable the movable cutter 34 to move through this portion. The lower portion of a wall 36 at the right side of the movable cutter driving section 30 is opened.

On the other hand, the upper end of the second projection 24 of the cutter fitting member 20 has a first side 25 that is parallel with the bottom side, and a second side 26 that is perpendicular to the first side 25. The removable fixed cutter 40 is disposed on the second projection while being positioned with the first side 25 and the second side 26.

More specifically, the fixed cutter 40 has a projection 41 that projects to the front and back directions in the drawing. The fixed cutter 40 is disposed such that a bottom surface 41*a* of this projection 41 is in close contact with the first side 25 of the cutter fitting member 20, and a right end surface 41*b* of the projection 41 is in close contact with the second side 26 of the cutter fitting member 20.

The process of disposing the fixed cutter 40 on the second projection 24 of the cutter fitting member 20 will be explained in detail below with reference to FIG. 2.

A platen supporting member 50 is fitted on the lower surface of the fixed cutter 40. The platen supporting member 50 has a pair of forked arms 51 that extend downward. These forked arms 51 support an shaft 61 of the platen 60.

The shaft 61 of the platen 60 extends to the outside of the platen supporting member 50. The platen stopper 13 having approximately a U-shape with the left side opened is clockwise rotatably fitted to the side walls 11 of the casing 10 at the supporting point 12. A recess 14 having an approximately a U-shape that is opened from the top end of the side walls 11 of the casing 10. The portion of the shaft 61 extended to the outside is inserted into the recess 14, while pressing the upper arm 13*a* of the platen stopper 13 aside.

The platen stopper 13 is always applied with force from the spring unit not shown so that the platen stopper 13 returns to the position shown in the drawing. Therefore, when the shaft 61 of the platen 60 has been inserted into the U-shaped recess 14, the platen stopper 13 returns to the position shown in the drawing, and the upper arm 13*a* presses the shaft 61 of the platen 60 to the right downward direction in the drawing. With this arrangement, the fixed cutter 40 that is connected with the shaft 61 of the platen 60 via the platen supporting member 50 is disposed as follows. The bottom surface 41*a* of the projection 41 is in close contact with the first side 25 of the cutter fitting member 20, and the right end surface 41*b* of the projection 41 is in close contact with the second side 26 of the cutter fitting member 20.

When the shaft 61 of the platen 60 is brought into contact with a bottom surface 14*a* of the U-shaped recess 14, there is the following possibility. The bottom surface 41*a* of the projection 41 of the fixed cutter 40 connected to the shaft 61 of the platen 60 via the platen supporting member 50 will be lifted, without being brought into contact with the first side 25 of the second projection 24 of the cutter fitting member 20. Therefore, a cut depth of the recess 14 is determined such that a gap d exists between the bottom 14*a* of the U-shaped recess 14 and the shaft 61 of the platen 60 when the shaft 61 of the platen 60 is disposed within the U-shaped recess 14.

Figure 2:
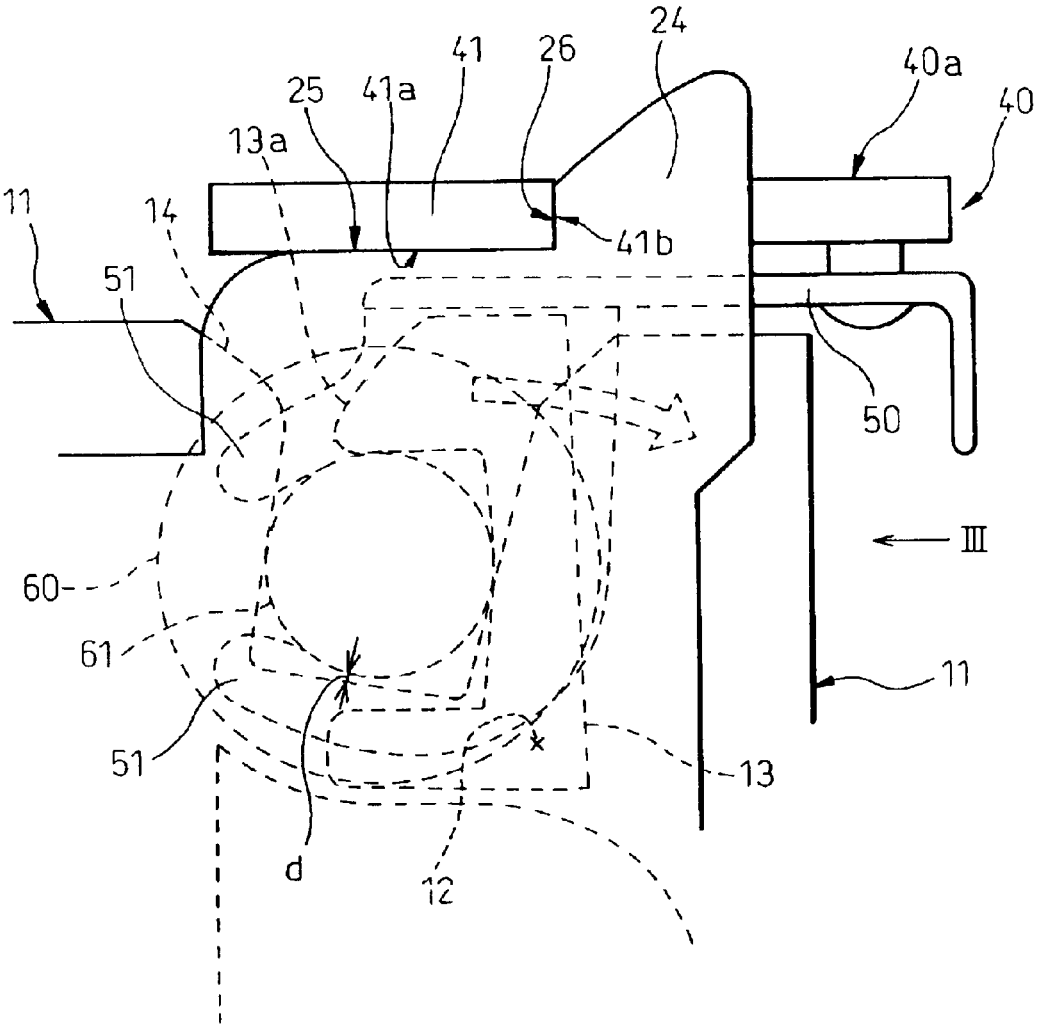
FIG. 2 is an enlarged view that explains the supporting of a platen shaft according to the first embodiment.
Figure 3:
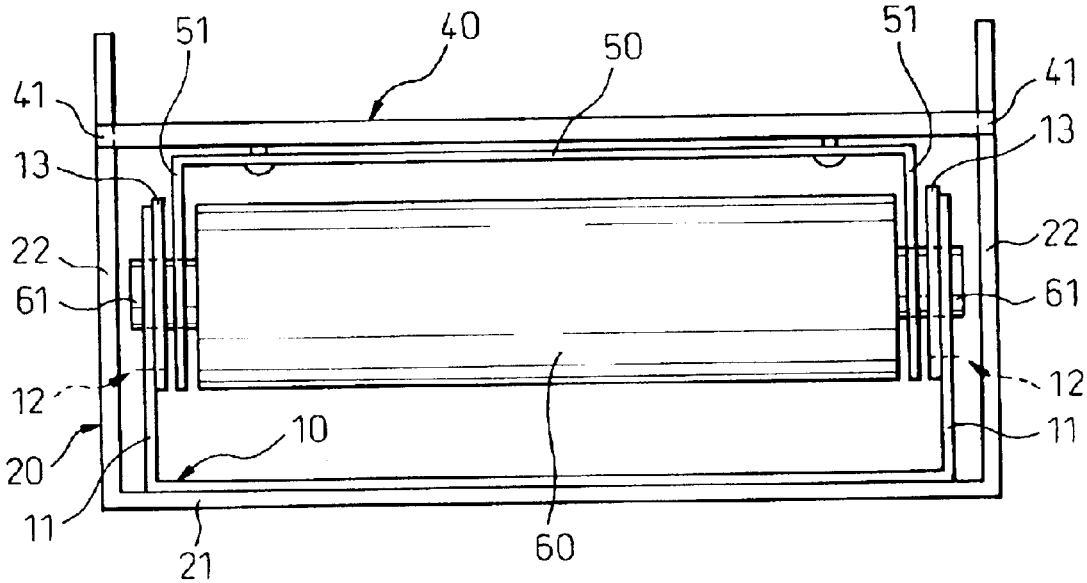
FIG. 3 is a front view of a layout of main parts according to the first embodiment.

FIG. 3 is a view that shows a positional relationship between the casing 10, the platen stopper 13, the cutter fitting member 20, the fixed cutter 40, the platen supporting member 50, and the platen 60 that are observed from a direction of an arrow mark III in FIG. 2. In order to avoid complexity in the drawing, other portions are omitted from the drawing.

As explained above, according to the first embodiment, the movable cutter driving section 30 is fixed to the cutter fitting member 20, and the movable cutter 34 moves on a moving line prescribed by the cutter fitting member 20. The fixed cutter 40 is not fixed to the first projection 23 of the cutter fitting member 20 with screws, but is positioned with the first side 25 and the second side 26 of the second projection 24 of the cutter fitting member 20. Therefore, the moving line of the movable cutter 34 and the fixed cutter 40 are held steady by the cutter fitting member 20. As a result, no variation occurs in the relative position between the movable cutter 34 and the fixed cutter 40.

According to the guillotine cutter, the lower edge of the V-shaped front end of the movable cutter cuts roll paper when this V-shaped front end moves in contact with the upper edge of the front end of the fixed cutter. Therefore, it is important that a relative angle between the movable cutter and the fixed cutter is set to an optimum value.

Figure 4:
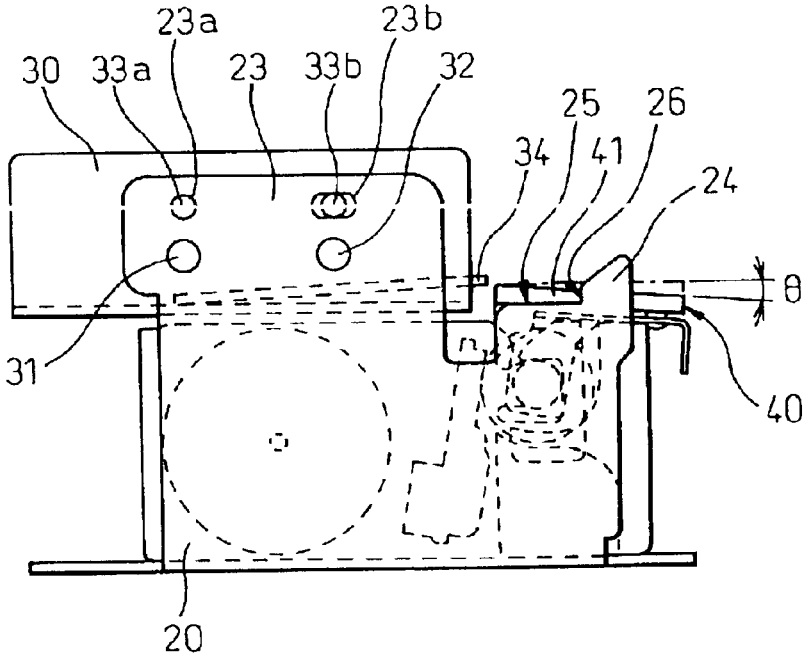
FIG. 4 is a side view of a printer according to a second embodiment of the present invention.

Therefore, by a second embodiment shown in FIG. 4, fitting of a movable cutter driving member 30 is kept constant, and a relative angle between a movable cutter and a fixed cutter is set to an optimum value as follows. An angle of a first side 25 of a second projection 24 of a cutter fitting member 20 is selected, and a second side 26 is set to form a right angle with the first side 25. An upper surface 40*a* of a fixed cutter 40 is parallel with a lower surface 41*a* of a projection 41 of the fixed cutter 40. A lower surface of the fixed cutter 40 is on the same plane as the lower surface 41*a* of the projection 41 of the fixed cutter 40 (refer to FIG. 2).

Figure 5:
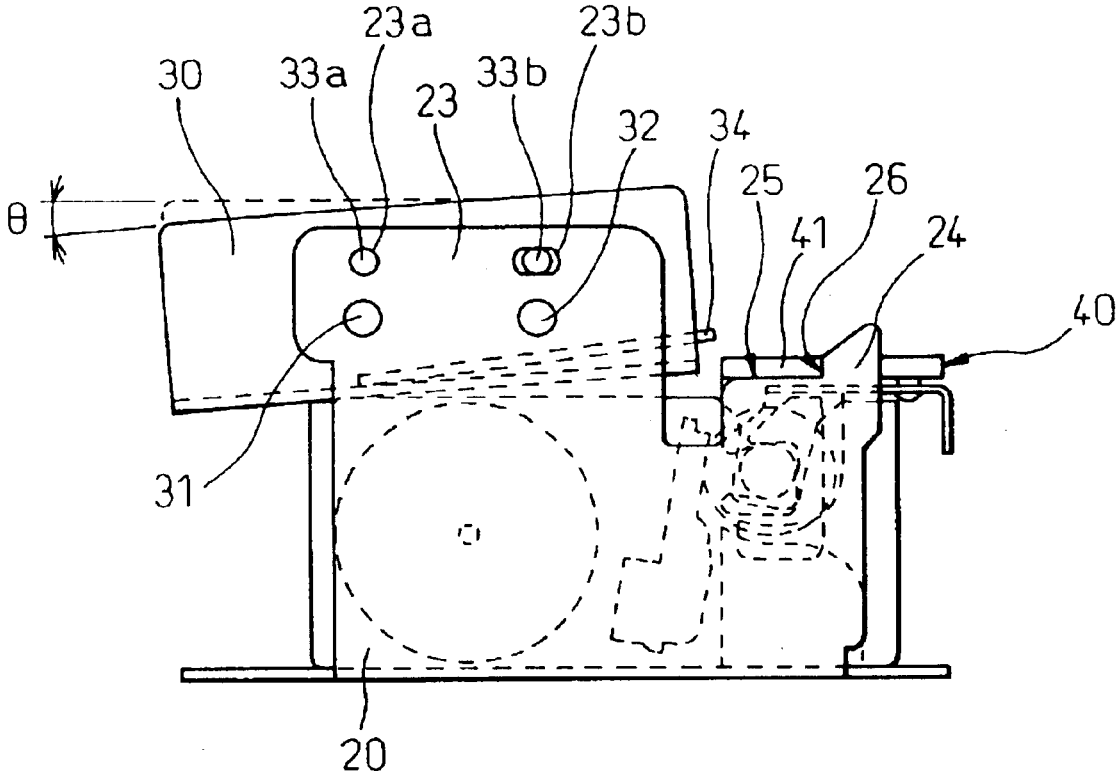
FIG. 5 is a side view of a printer according to a third embodiment of the present invention.

On the other hand, by a third embodiment shown in FIG. 5, an angle of a first side 25 of a second projection 24 of a cutter fitting member 20 is kept constant. For example, the first side 25 is set parallel with a bottom plate 21 of the cutter fitting member 20, and positions of positioning holes 23*a* and 23*b* of the cutter fitting member 20 for fitting a movable cutter driving member 30 are adjusted.

Next, a fourth embodiment will be explained. In the fourth embodiment, the fitting position of the movable cutter driving member 30 of the first embodiment is set close to or far from the fixed cutter 40, to prepare for a full cut (a complete cutting) and a partial cut (a cutting leaving a small part not cut). FIG. 6A is a top plan view and FIG. 6B is a side view of a maximum projection position of a movable cutter 34 when a full cut is carried out.

Figure 6B:
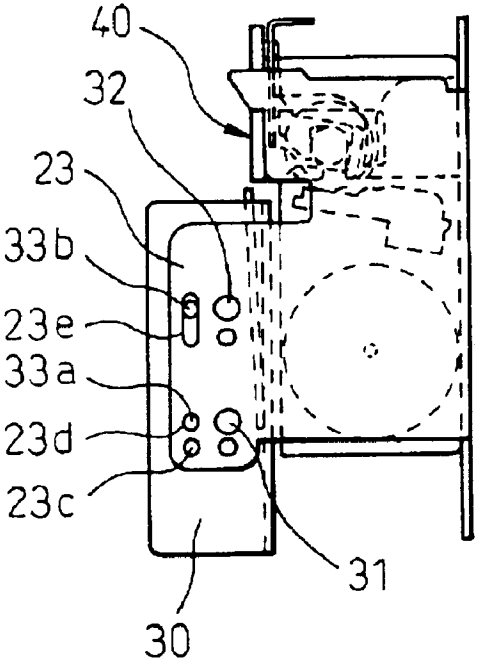
FIG. 6A is a top plan view and FIG. 6B is a side view of a printer that explain a full cut according to a fourth embodiment of the present invention.
Figure 6A:
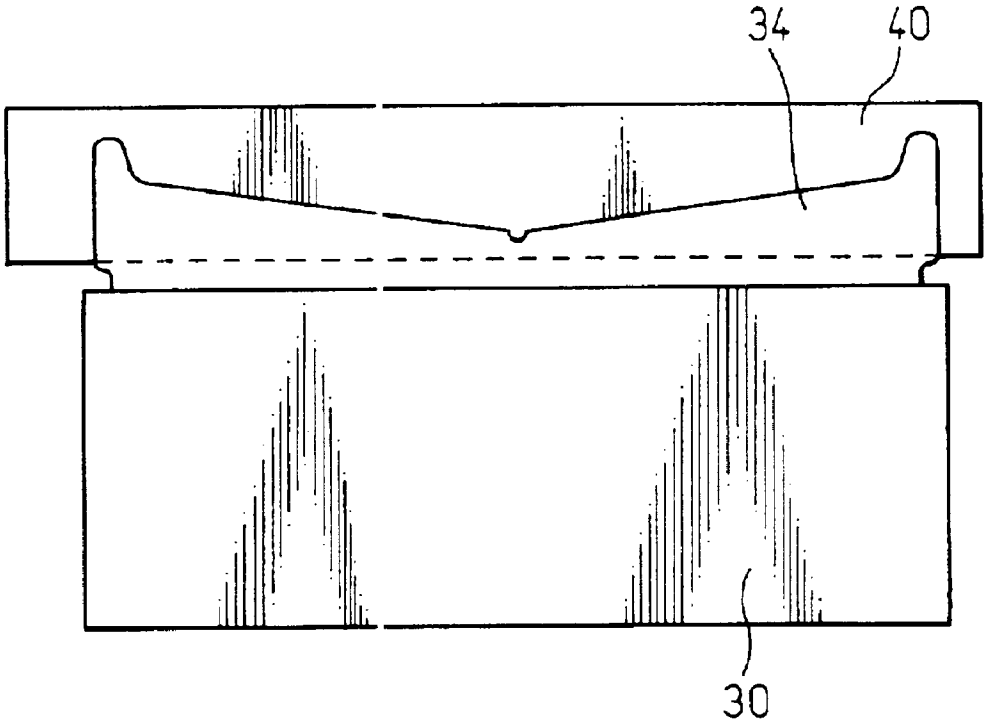

As shown in FIG. 6B, two positioning holes 23*c* and 23*d* corresponding to the positioning hole 23*a* of the first embodiment are provided in advance on a first projection 23 of a cutter fitting member 20. Further, a positioning hole 23*e* corresponding to the positioning hole 23*b* of the first embodiment is provided in advance on the first projection 23 of a cutter fitting member 20. The positioning hole 23*e* is formed as an ellipse having a larger size than a connected size of the positioning holes 23*c* and 23*d*. Four screw holes for screws 31 and 32 are provided in the same intervals as the interval between the positioning holes 23*c* and 23*d*. Small projections 33*a* and 33*b* and screw stopping holes that are the same as those of the first embodiment are provided on a movable cutter driving member 30.

The small projections 33*a* and 33*b* provided on the movable cutter driving member 30 are engaged with the positioning holes 23*d* and 23*e*. The screws 31 and 32 pass through the screw piercing holes closer to a fixed cutter 40, and the movable cutter driving member 30 is fitted to the cutter fitting member 20.

Figure 7B:
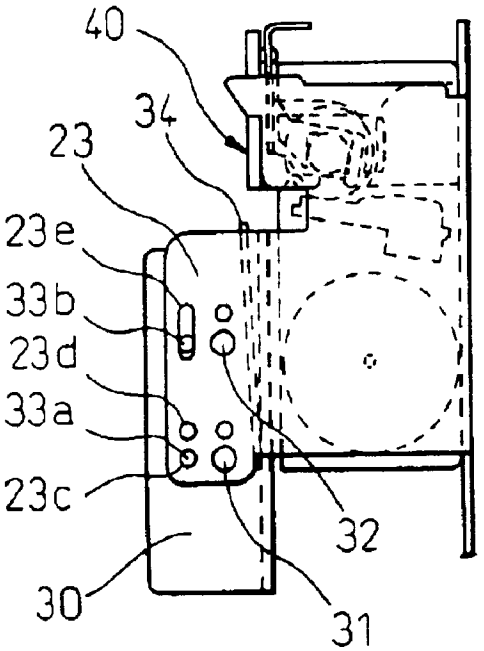
FIG. 7A is a top plan view and FIG. 7B is a side view of the printer that explain a partial cut according to the fourth embodiment of the present invention.
Figure 7A:
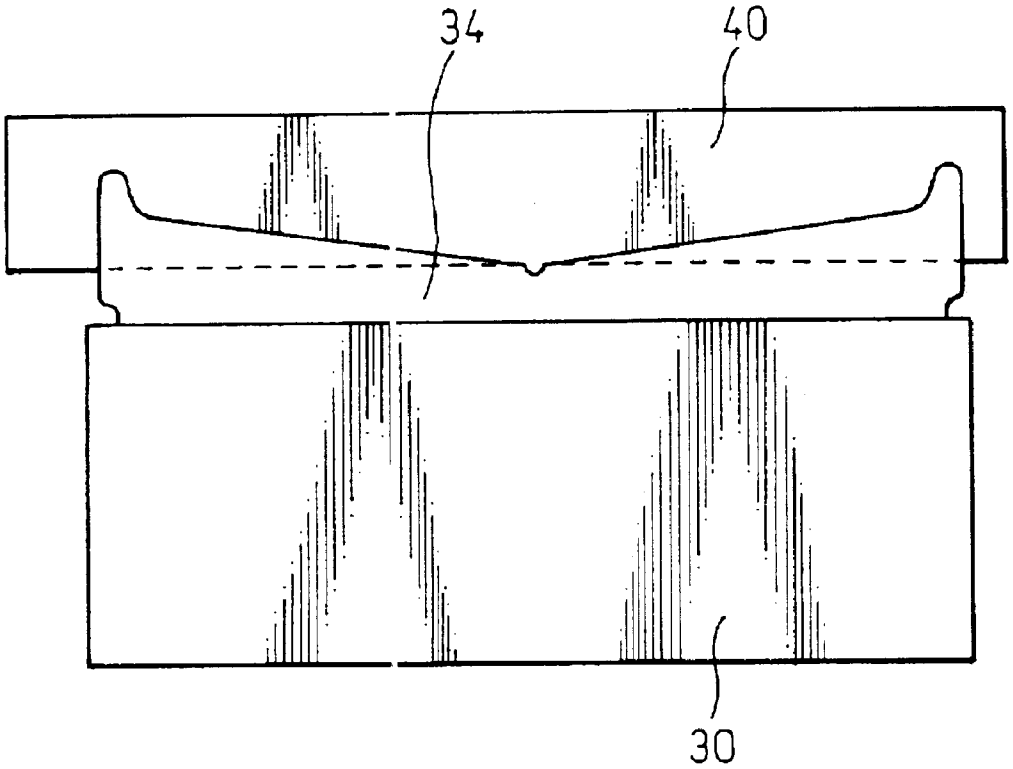

FIG. 7A is a top plan view and FIG. 7B is a side view that show a maximum projection position of the movable cutter 34 when a partial cut (leaving a small part not cut at the center) is carried out. The small projections 33*a* and 33*b* provided on the movable cutter driving member 30 are engaged with the positioning holes 23*c* and 23*e*. The screws 31 and 32 are passed through the screw piercing holes farther from the fixed cutter 40, and the movable cutter driving member 30 is fitted to the cutter fitting member 20. In the fourth embodiment, it is possible to change over easily between the full cut and the partial cut, based on the above arrangement.

Figure 8:
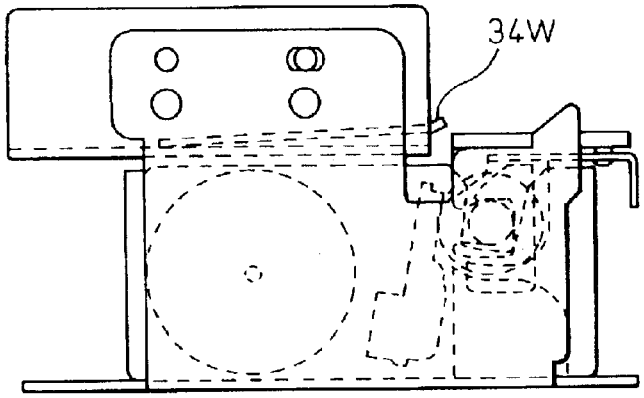
FIG. 8 is a side view of a printer according to a fifth embodiment of the present invention.

FIG. 8 is a view that explains a fifth embodiment. In the sixth embodiment, end portions 34*w* in the width direction of the movable cutter 34, that are first brought into contact with the fixed cutter 40 at the cutting time, are bent upward on the fixed cutter side. With this arrangement, the ride of the movable cutter 34 on the fixed cutter 40 at the beginning of moving e becomes smooth.

Figure 9A:
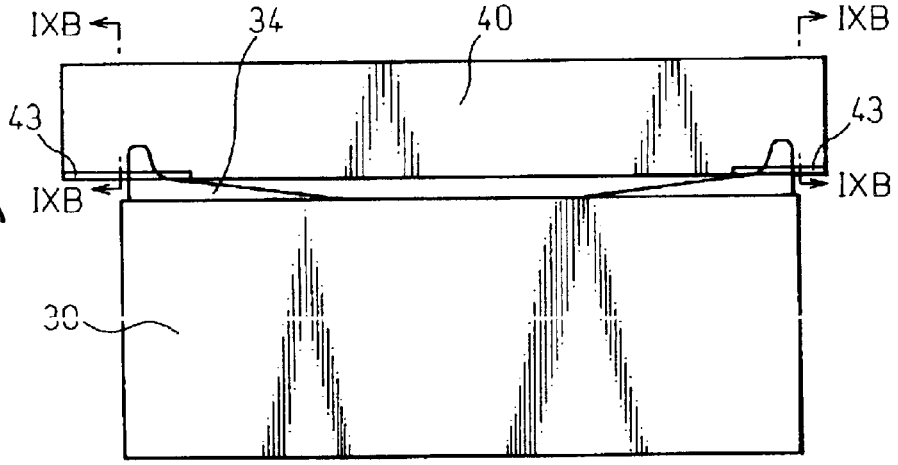
FIG. 9A is a top plan view and FIG. 9B is a cross-sectional view cut along the line IXB—IXB in FIG. 9A that explain a printer according to a sixth embodiment of the present invention.
Figure 9B:
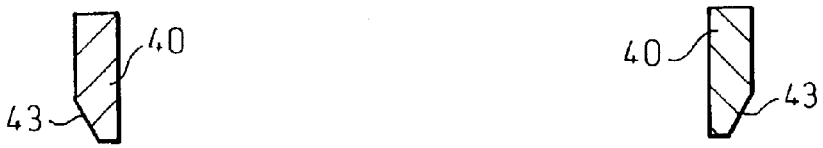

FIG. 9A and FIG. 9B are views that explain a sixth embodiment. In the sixth embodiment, cutouts 43 are made at both ends in width direction (portions that do not carry out a cut operation) of the upper edge at the movable cutter side of the fixed cutter 40. With this arrangement, the ride of the movable cutter 34 on the fixed cutter 40 at the beginning of moving becomes smooth, in a similar manner to that in the fifth embodiment.

Figure 10A:
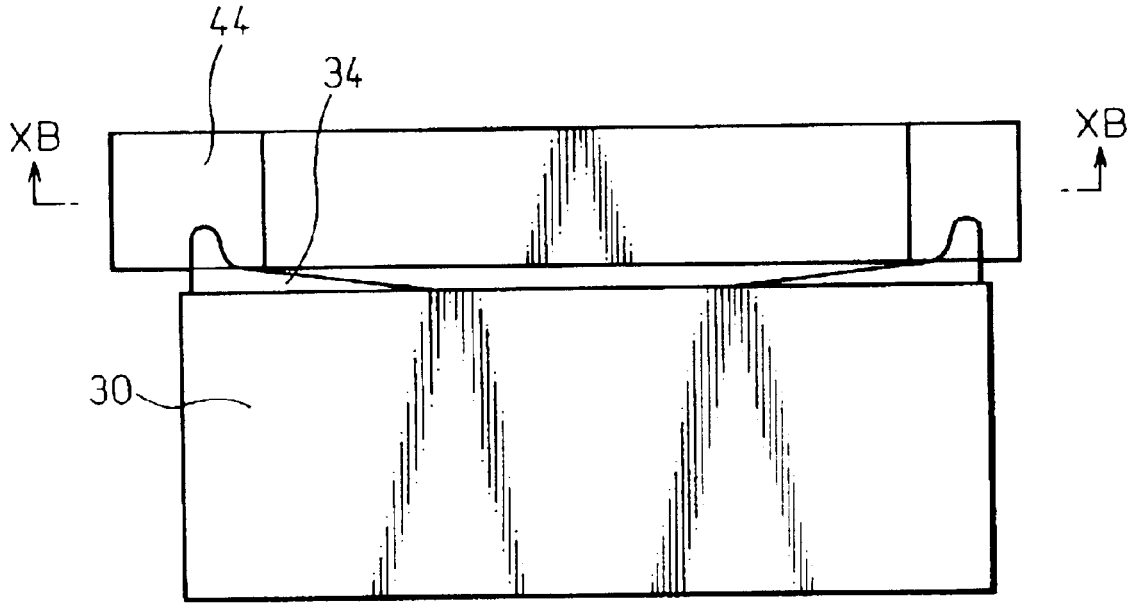
FIG. 10A is a top plan view and FIG. 10B is a cross-sectional view cut along the line XB—XB in FIG. 10A that explain a printer according to a seventh embodiment of the present invention.
Figure 10B:
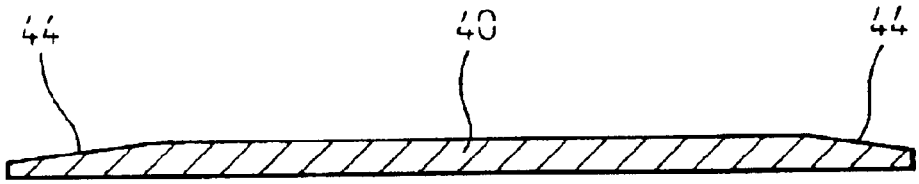

FIG. 10A and FIG. 10B are views that explain a seventh embodiment. In the seventh embodiment, tapers 44 which is tapering downward and outward are formed at both ends in width direction (portions that do not carry out a cut operation) of the fixed cutter 40. With this arrangement, the ride of the movable cutter 34 on the fixed cutter 40 at the beginning of the moving becomes smooth, in a similar manner to that in the fifth and sixth embodiments.

An eighth embodiment will be explained next. In the eighth embodiment, a platen supporting member 50 is fitted to a fixed cutter 40 via a spring member.

Figure 11A:
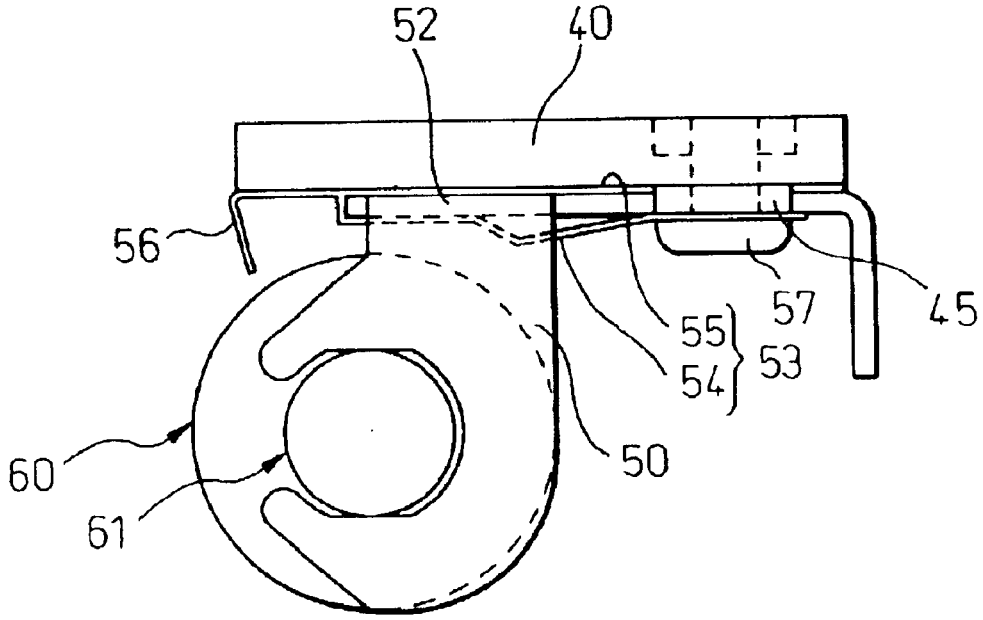
FIG. 11A and FIG. 11B are views of a printer according to an eighth embodiment of the present invention.
Figure 11B:
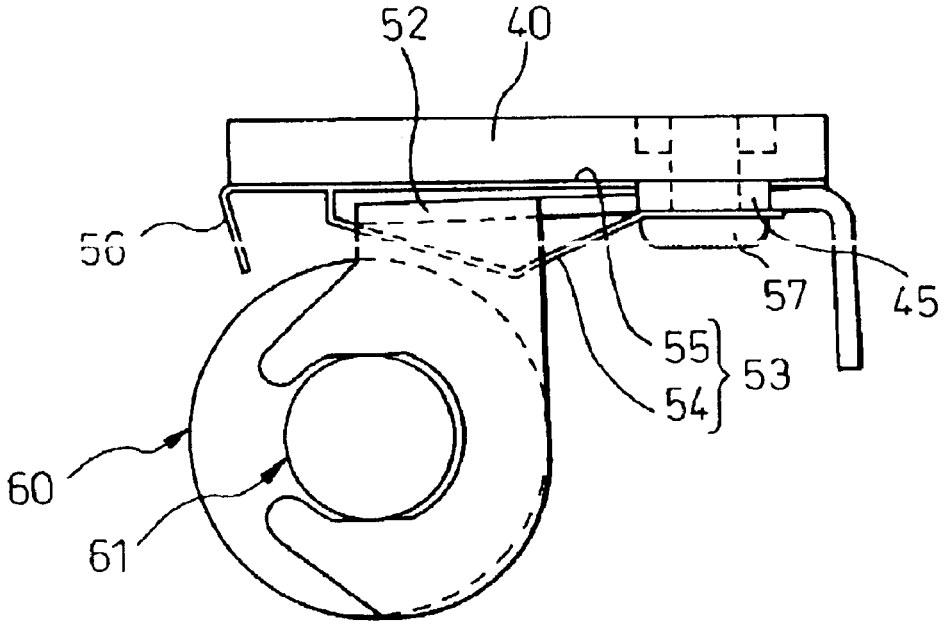

FIG. 11A and FIG. 11B are views that explain a structure and operation of a printer of the eighth embodiment. Referring to FIG. 11A, a spring member 53 is formed with spring steel, and is disposed at a center in the width direction of a fixed cutter 40. The spring member 53 has a lower spring portion 54 and an upper spring portion 55. The lower spring portion 54 is fixed to a lower projection 45 provided on the fixed cutter 40 with a screw 57. An upper surface 52 of a platen supporting member 50 is positioned between the lower spring portion 54 and the upper spring portion 55. All of the upper spring portion 55 is closely contacted to the lower surface of the fixed cutter.

The lower spring portion 54 protrudes downward in the movable cutter side from the screw stopping section, and always applies force to the upper surface 52 of the platen supporting member 50 toward the fixed cutter 40. When an shaft 61 of a platen 60 is pressed downward with a platen stopper 13 (refer to FIG. 2), the upper surface 52 of the platen supporting member 50 is also pressed downward as shown in FIG. 11B. As a result, the lower spring portion 54 of the spring member 53 that protrudes downward at the movable cutter side from the screw stopping section is lowered. Then, the lower spring portion 54 tries to return to the state shown in FIG. 11A. Consequently, a downward force is applied to the fixed cutter 40. A projection 41 (refer to FIG. 2) of the fixed cutter 40 applied with the downward force is brought into contact with a first side 25 of a second projection 24 of a cutter fitting member 20, and is positioned.

The upper spring 55 of the spring member 53 is bent downward at the end of the movable cutter side, and forms a roll paper guide 56 that prevents a jam of the roll paper.

According to the eighth embodiment having the above structure, it becomes possible to position the fixed cutter 40 more securely.

Figure 12:
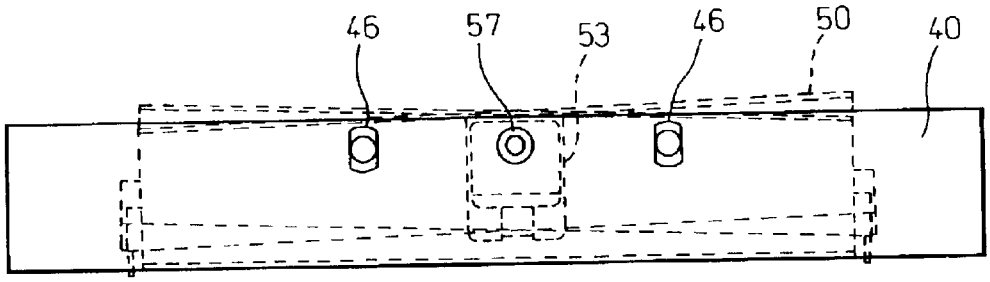
FIG. 12 is a view that explains a spring section in detail according to a ninth embodiment. fixed

FIG. 12 is a view that explains a ninth embodiment. In the ninth embodiment, in a structure of fitting a platen supporting member to a fixed cutter 40 with a spring member 53, like in the eighth embodiment, positioning holes 46 are provided on the fixed cutter 40 in the form of elliptical holes.

It is possible to fit a platen 60 to the fixed cutter 40 in non-parallel arrangement, by enabling a rotation and parallel movement of the platen 60. With this arrangement, it is possible to fit the platen 60 in parallel with a thermal head 80, even when a thermal printer including the thermal head 80 is not parallel with the fixed cutter 40.

While the first to ninth embodiments of the present have been explained above, it is also possible to suitably combine these embodiments.

As explained above, according to the present invention, the printer comprises a guillotine cutter having a fixed cutter and a movable cutter that is movable toward the fixed cutter. A platen is fitted to the fixed cutter via a platen supporting member, with the fixed cutter set removable together with the platen. The printer has a cutter fitting member fixed and integrally formed with a printer casing that accommodates a printer main body including a printing section. The cutter fitting member has a bottom plate and a pair of side plates erected on the bottom plate. A movable cutter driving member that drives the movable cutter is positioned on the cutter fitting member with a movable cutter positioning unit. The fixed cutter is positioned on the cutter fitting member with a fixed cutter positioning unit, and the fixed cutter positioning unit is formed on the upper end of the side plates of the cutter fitting member. According to the printer having the above structure, the movable cutter and the fixed cutter of the guillotine cutter are positioned on the cutter fitting member that is integrally formed and has a bottom plate and a pair of side plates erected on the bottom plate. Therefore, a relative position is not deviated. Further, as the fixed cutter is formed on the upper end of the side plates of the cutter fitting member, it is easy to carry out the processing. It is also possible to use a conventional printer casing.

Further, as the structure is easy for machining, it becomes easy to change a relative position and relative angle of the fixed cutter and the movable cutter. It is also easy to change between a partial cut and a full cut.

What is claimed is:

1. A printer with a guillotine cutter having a fixed cutter and a movable cutter that is movable toward the fixed cutter, comprising:

a cutter fitting member fixed and integrally formed with a printer casing that accommodates a printer main body having a printing section, the cutter fitting member having a bottom plate and a pair of side plates erected on the bottom plate;

a movable cutter driving member that drives the movable cutter and is positioned on the cutter fitting member with a movable cutter positioning unit;

a fixed cutter positioning unit to position the fixed cutter on the cutter fitting member, the fixed cutter positioning unit being formed on upper ends of the side plates of the cutter fitting member; and a platen supporting member provided with the fixed cutter to support a platen, the fixed cutter being removable from the cutter fitting member together with the platen supporting member.

2. The printer according to claim 1, further comprising:

a platen stopper fitted to the printer casing; and a guide provided on the printer casing, wherein when a shaft of the platen, fitted to the fixed cutter via the platen supporting member, is positioned in the guide provided on the printer casing, the platen stopper applies force to press the fixed cutter against the fixed cutter positioning unit.

3. The printer according to claim 1, wherein a full cut and a partial cut are selectable by changing the position of the movable cutter drive member using the movable cutter positioning unit.

4. A printer comprising a guillotine cutter having a fixed cutter and a movable cutter that is movable toward the fixed cutter, wherein the fixed cutter is provided with a platen via a platen supporting member, and is removable together with the platen, the printer has a cutter fitting member fixed and integrally formed with a printer casing that accommodates a printer main body including a printing section, the cutter fitting member having a bottom plate and a pair of side plates erected on the bottom plate, a movable cutter driving member that drives the movable cutter is positioned on the cutter fitting member with a movable cutter positioning unit, the fixed cutter is positioned on the cutter fitting member with a fixed cutter positioning unit, with the fixed cutter positioning unit formed on the upper end of the side plates of the cutter fitting member, and the platen supporting member is fitted to the fixed cutter via a spring member, and the spring member always applies force to the platen supporting member against the fixed cutter.

5. The printer according to claim 4, wherein a roll paper guide formed on the spring member to prevent paper jams.

6. The printer according to claim 1, wherein the platen supporting member is loosely fitted to the fixed cutter.

7. A printer with a printer casing, a fixed cutter, and a movable cutter that is movable toward the fixed cutter, comprising:

a cutter fitting member fixed and integrally formed with the printer casing, the cutter fitting member having a bottom plate and a pair of side plates erected on the bottom plate, with the fixed cutter being positioned between the side plates of the cutter fitting member;

a movable cutter driving member driving the movable cutter and being positioned on the cutter fitting member; and a platen supporting member provided with the fixed cutter to support a platen, the fixed cutter being removable from the cutter fitting member together with the platen supporting member.

* * * * *